US007383715B2

(12) United States Patent
Kutschker

(10) Patent No.: US 7,383,715 B2
(45) Date of Patent: Jun. 10, 2008

(54) BENDING APPARATUS AND METHOD FOR BENDING FLAT MATERIALS

(75) Inventor: Wolfgang Kutschker, Boeblingen (DE)

(73) Assignee: RAS Reinhardt Maschinenbau (DE)

( * ) Notice: Subject to any disclaimer, the term of this patent is extended or adjusted under 35 U.S.C. 154(b) by 0 days.

(21) Appl. No.: 11/729,108

(22) Filed: Mar. 28, 2007

(65) Prior Publication Data

US 2007/0180886 A1 Aug. 9, 2007

Related U.S. Application Data

(63) Continuation of application No. PCT/EP2005/009859, filed on Sep. 14, 2005.

(30) Foreign Application Priority Data

Sep. 28, 2004 (DE) ..... 10 2004 048 036

(51) Int. Cl.
*B21D 43/10* (2006.01)

(52) U.S. Cl. ..... 72/422; 72/420

(58) Field of Classification Search ..... 72/17.3, 72/18.1, 18.6, 37, 319, 322, 323, 419, 420, 72/421, 422

See application file for complete search history.

(56) References Cited

U.S. PATENT DOCUMENTS

| | | | | |
|---|---|---|---|---|
| 4,827,757 | A | 5/1989 | Sartorio | |
| 5,058,406 | A | 10/1991 | Sartorio et al. | |
| 5,343,727 | A * | 9/1994 | Osaka | 72/306 |
| 5,857,377 | A * | 1/1999 | Sartorio | 72/422 |
| 5,964,119 | A | 10/1999 | Kutschker | |
| 6,192,297 | B1 * | 2/2001 | Marobin | 700/245 |
| 6,317,953 | B1 * | 11/2001 | Pryor | 29/407.04 |
| 6,516,648 | B1 | 2/2003 | Kutschker et al. | |
| 6,644,080 | B2 * | 11/2003 | Lindstrom | 72/19.4 |
| 7,059,164 | B2 * | 6/2006 | Kobayashi | 72/319 |

FOREIGN PATENT DOCUMENTS

| | | |
|---|---|---|
| DE | 37 44315 | 7/1988 |
| DE | 39 02149 | 8/1989 |
| EP | 0 354 559 | 2/1990 |

(Continued)

*Primary Examiner*—Edward Tolan
(74) *Attorney, Agent, or Firm*—Reinhart Boerner Van Deuren P.C.

(57) ABSTRACT

To improve a bending apparatus for flat material parts, comprising a bending device at which the flat material part is positioned in an insertion plane prior to bending and remains in the insertion plane during bending, and a handling device having handling axes for picking up the flat material part from a feed position, inserting it into the bending device for bending, taking it out of the bending device and placing it in a deposit position, so that the bending apparatus requires as little constructional expenditure as possible, it is proposed that the handling device comprise a positioning axis, that the positioning axis have a greater positioning accuracy than the handling axes, that, when positioning the flat material part in at least one bending position relative to a bending line of the bending device, the positioning axis be aligned parallel to the insertion plane and parallel to a direction extending transversely to the bending line, and that, with handling axes rigidly secured, the flat material part be able to be transferred by the positioning axis from a measurement position to the at least one bending position.

45 Claims, 15 Drawing Sheets

FOREIGN PATENT DOCUMENTS

| | | |
|---|---|---|
| EP | 0 462 286 | 3/1995 |
| EP | 0 742 054 | 11/1996 |
| EP | 0 714 329 | 10/1997 |
| WO | WO 98/14288 | 4/1998 |
| WO | WO 00/43141 | 7/2000 |

* cited by examiner

BENDING APPARATUS AND METHOD FOR BENDING FLAT MATERIALS

CROSS-REFERENCE TO RELATED PATENT APPLICATIONS

This application is a continuation of international application number PCT/EP2005/009859 filed on Sep. 14, 2005 and German application number 10 2004 048 036.2 of Sep. 28, 2004, the teachings and disclosure of which are hereby incorporated in their entirety by reference thereto.

BACKGROUND OF THE INVENTION

The invention relates to a bending apparatus for flat material parts, comprising a bending device at which the flat material part is positioned in an insertion plane prior to bending and remains in the insertion plane during bending, and a handling device having handling axes for picking up the flat material part from a feed position, inserting it into the bending device for bending, taking it out of the bending device and placing it in a deposit position.

Such bending apparatuses are known from the prior art, for example, from WO 98/14288.

In these bending apparatuses, all handling axes have such a positioning accuracy as is required for the exact positioning of the flat material part for bending.

This solution demands a complex construction, particularly in the case of complicated handling devices having a large number of handling axes.

The object underlying the invention is, therefore, to so improve a bending apparatus of the generic kind that it requires as little constructional expenditure as possible.

SUMMARY OF THE INVENTION

This object is accomplished in a bending apparatus of the kind described at the outset, in accordance with the invention, in that the handling device comprises a positioning axis, that the positioning axis has a greater positioning accuracy than the handling axes, that, when positioning the flat material part in at least one bending position relative to a bending line of the bending device, the positioning axis is aligned parallel to the insertion plane and parallel to a direction extending transversely to the bending line, and that, with handling axes rigidly secured, the flat material part is able to be transferred by the positioning axis from a measurement position to the at least one bending position.

The advantage of the solution according to the invention is to be seen in that it opens up the possibility of implementing the handling axes constructionally with a lesser positioning accuracy than the positioning axis and of achieving the accuracy required for the precision of the bending of the flat material part by solely the positioning axis being active in order to take the flat material part from a measurement position in which the alignment of the flat material part relative to the bending device is detected and fixed, into the at least one bending position in which a bending of the flat material part is carried out.

Owing to the fact that the handling axes with their lesser degree of positioning accuracy remain rigidly secured during this movement, their lesser degree of positioning accuracy does not affect the accuracy of the bending operation.

Furthermore, in accordance with the invention, the positioning axis can also be simultaneously employed as handling axis, and, therefore, the possibilities of movement available to the handling device need not be limited, namely when one of the handling axes is configured as positioning axis, or the possibilities of movement are extended, namely when the positioning axis, which can simultaneously also be employed in the usual handling operations, is added to the handling axes.

Owing to the positioning axis being aligned parallel to a direction extending transversely to the bending line, a displacement of the flat material part between the measurement position and the bending position has the effect of a parallel displacement relative to the bending line and, therefore, brings about only a slight displacement in the direction of the bending line.

It is advantageous for the positioning axis to be aligned parallel to a direction extending substantially perpendicularly to the bending line, so that displacements in the direction of the bending line are minor in terms of accuracy.

The extending of the direction substantially perpendicularly to the bending line is to be understood as the direction lying in an angular range of between approximately 70° and approximately 110° in relation to the bending line.

If, however, flat material parts are also to be positioned with a high degree of precision in the direction of the bending line, i.e., for example, flat material parts on which a least one bending edge already exists transversely to the bending line, it is particularly expedient for the positioning axis to be aligned parallel to a direction extending perpendicularly to the bending line.

Moreover, in conjunction with the solution according to the invention, for a sufficiently high degree of accuracy of the positioning of the flat material it is necessary for the angle between the bending line and the direction extending transversely to the bending line to be known, so that, if this direction does not extend perpendicularly to the bending line, the path traveled in the direction of the positioning axis can be converted into a path perpendicular to the bending line.

Further details of the configuration of the handling axes have so far not been given.

In principle, all handling axes could be configured as linear axis.

A particularly expedient solution provides that the handling device comprises rotational axes as handling axes. This does not mean that all handling axes must be rotational axes. It is also quite conceivable for some of the handling axes to be configured as linear axes and others as rotational axes.

To enable bending in a simple way on all sides of the flat material part in the bending apparatus according to the invention, it is preferably provided that the handling axis is an axis of rotation extending perpendicularly to a plane in which the flat material part substantially extends.

Furthermore, it is expedient for one of the handling axes to be an axis of rotation extending parallel to the plane in which the flat material part substantially extends, so as to be able to align the flat material part in a suitable manner parallel to the plane in which it substantially extends.

For this reason, it is particularly expedient for the handling device to comprise at least two rotational axes as handling axes.

It is even more advantageous for the handling device to comprise at least five rotational axes as handling axes.

To enable optional aligning and positioning of the flat material part within a spatial area, it has proven particularly advantageous for the handling device to comprise at least six rotational axes as handling axes.

The handling of the flat material part can be carried out in a particularly expedient manner with the handling device according to the invention when this has an articulated arm comprising two arms adapted for swivel movement relative to each other about an axis of articulation.

Access to the feed position and to the deposit position with insertion of the flat material part into the bending device can be achieved in a simple manner with such an articulated arm.

To enable the flat material part to be picked up in a simple manner with the handling device, it is preferably provided that the handling device comprises a flat material holder with which the flat material part can be picked up, moved into the bending device, positioned for bending, and finally deposited in the deposit position.

The flat material holder is preferably configured such that with it the flat material part is grippable on a flat side thereof, i.e., the flat material holder does not have to engage over both flat sides but can reliably grip the flat material part from one flat side.

Such gripping can be performed using, for example, vacuum suction elements or gripper elements based on magnetic interaction.

In particular, when the handling device is provided with an articulated arm, it is preferably provided that the flat material holder is held at one end of the articulated arm and is rotatable relative thereto about three axes of rotation extending transversely to one another.

A first one of the axes of rotation preferably extends perpendicularly to a plane in which the flat material part held by the flat material holder substantially extends.

Furthermore, it is expedient for a second one of the axes of rotation to extend parallel to the plane in which the flat material part held on the flat material holder substantially extends.

Finally, a further expedient solution provides that a third one of the axes of rotation extends transversely to the axis of articulation.

Details have so far not been given as to the further design of the handling device. A particularly expedient solution provides that the handling device comprises a swivel arm base.

It is expediently provided that the articulated arm is adapted for swivel movement about a swivel axis relative to the swivel arm base.

It is particularly expedient for the swivel axis to extend parallel to the axis of articulation of the articulated arm.

Furthermore, the swivel arm base is expediently rotatable about an approximately vertical axis of rotation of the base relative to a foot part.

In the above explanation of the individual embodiments, the alignment of the positioning axis was not generally defined, but solely in conjunction with the positioning of the flat material part in the bending position.

Accordingly, the positioning axis could be provided at any point on the handling device, for example, between two different handling axes, in particular, between different rotational axes.

This does, however, have the disadvantage that before employing the positioning axis for moving the flat material part from the measurement position to the bending position, an exactly reproducible alignment of the positioning axis or an alignment of the positioning axis that is known with the necessary accuracy is required in order to have calculatable conditions for determining the path to be traveled in the direction of the positioning axis.

For this reason, a constructionally particularly simple and advantageous solution provides that in all positions of the handling device, the direction parallel to the positioning axis extends with the same alignment transversely, preferably substantially perpendicularly, to the bending line.

By fixing the positioning axis once it is thereby ensured that the direction parallel thereto always extends exactly with the same alignment transversely, preferably substantially perpendicularly, to the bending line.

It is particularly advantageous for the positioning axis to also be arranged so as to extend parallel to the insertion plane in all positions of the handling device.

The positioning axis could, in principle, be an axis that is optionally made up of movements.

A particularly expedient solution provides that the positioning axis is a linear axis since the required alignment of the positioning axis can be accomplished in a particularly simple way with such a linear axis.

It is also particularly expedient for the positioning axis to be arranged so as to bring about a movement of all other handling axes relative to the bending device, so that the alignment of the positioning axis relative to the bending line and relative to the insertion plane is inevitably maintained independently of the movements of the other handling axes.

Furthermore, regarding the arrangement of the positioning axis, it is expedient for it to be an axis which moves the swivel arm base relative to the bending device.

In the simplest case, the positioning axis is implemented by a carriage.

In order to move the swivel arm base with the carriage, it is expediently provided that the carriage carries the foot part.

Moreover, in the case of elongated, but relatively narrow flat material parts, to enable insertion of these in a suitable manner into the bending device, the handling device is provided with a holder positioning axis which makes it possible to displace the flat material holder relative to its connection to the handling device.

The holder positioning axis is preferably arranged so that with it the flat material holder is moveable relative to the handling axes.

In principle, the holder positioning axis could be configured as an axis monitored by a control system for bringing about optional displacement between two end positions.

However, in order to configure the holder positioning axis as simply as possible, it is expediently provided that the holder positioning axis is designed so as to allow movement between two defined end positions, i.e., that the holder positioning axis allows a definitive and reproducible positioning of the flat material holder relative to the handling device in two end positions only.

To enable the holder positioning axis to be expediently employed, in particular, in the case of long, but narrow flat material parts, it is preferably provided that the holder positioning axis is aligned perpendicularly to the longest side edge of the flat material part, i.e., that in this case the flat material part must be picked up by the flat material holder such that this alignment of the holder positioning axis in relation to the flat material part is ensured.

Further details of the design of the bending device have so far not been given. In principle, the bending device could be of optional design as long as the flat material part remains in the insertion plane during bending and can thereby be kept in it by the handling device.

An expedient embodiment of the bending device provides that the bending device comprises clamping tools which clamp the flat material part in the insertion plane, so that the flat material part is thereby additionally fixed during bending.

In the event clamping tools are used, a particularly expedient solution provides that the bending device comprises a bending tool arranged on a side of the clamping tools that is located opposite the handling device, so that the handing device holds the flat material part in alignment in the insertion plane on the one side of the clamping tools, while the bending is carried out on the opposite side of the clamping tools.

Nor have any details been given in the above explanation of the individual embodiments regarding the detection of the flat material part in the measurement position. An advantageous solution provides that the bending apparatus is provided with a measuring device, with which a position of the flat material part is detectable in the measurement position.

Such a measuring device can be configured in many different ways.

For example, it can be designed so as to detect the course followed by at least one edge of the flat material part.

A particularly efficient and expedient solution provides that the measuring device detects the position of the flat material part at two measurement points arranged at a distance from each other.

The measurement points can be expediently positioned so as to detect areas of the flat material parts that represent as precisely as possible the alignment or the dimension of the flat material part.

For example, it is conceivable to provide areas of the flat material part that have been worked on in a previous operation, for example, cut-out areas of the flat material part, as such measurement points.

In principle, the measurement points could be arranged on a side of the clamping tool that faces the handling device. For reasons relating to as slight a movement as possible of the flat material part between the measurement position and the bending position and, particularly with a view to as universal an employability as possible of the measuring device, in particular, for example, also for detecting bent portions, it is advantageous for the measurement points to lie on a side of the clamping tools that is located opposite the handling device.

As the flat material part is usually provided with bends in which the bending line extends parallel to the measurement points, it is preferably provided that the measurement points lie in a plane which extends parallel to the bending line.

Furthermore, it is preferably provided that the plane in which the measurement points lie extends perpendicularly to the insertion plane.

The measurement points can be detected in many different ways.

It is preferably provided that the measuring device comprises a sensor arrangement for detecting the measurement points.

The sensor arrangement can be arranged fixedly relative to one of the clamping tools.

A solution which is particularly expedient in terms of accessibility provides that the sensor arrangement is arranged on a bending tool carrier.

In this case, an exact positioning of the bending tool has to be ensured when detecting the measurement position.

For example, the sensor arrangement could still be mechanical tactile sensors.

A particularly expedient solution does, however, provide that the measuring device comprises an optical sensor arrangement and a reflector arrangement located opposite the optical sensor arrangement. The measurement points can be monitored in a particularly simple way with such an optical measuring device, and, consequently, the position and the alignment of the flat material parts can be precisely recognized.

In particular, a large number of measurement points in the measurement plane can be easily detected with such an optical measuring device.

Further details of the arrangement of the clamping tools have so far not been given. If the clamping tools are to precisely fix the flat material part and, in addition, clamp it with great force, in order to achieve an exact bending, it is preferably provided that the clamping tools are arranged on beams which carry these.

As the beams carrying the clamping tools must have a relatively large expanse in order to achieve the necessary stability for the clamping tools, it is preferably provided that a beam for a lower one of the clamping tools has a recess for at least partially receiving the flat material holder.

Such a recess makes it possible to approach the respective clamping tool as closely as possible with the flat material holder and, consequently, to also bend small workpieces with the bending apparatus according to the invention.

Moreover, a further advantageous embodiment provides that the beam carrying the upper clamping tool has a recess for at least partially receiving the flat material holder, so that in the case of small workpieces, the flat material holder can also be moved up as closely as possible to the upper clamping tool.

The invention also relates to a method for bending flat material parts with a bending device at which the flat material part is positioned in an insertion plane prior to bending and remains in the insertion plane during bending, and with a handling device, which has handling axes, and with which the flat material part is picked up from a feed position, inserted into the bending device for bending, taken out of the bending device and placed in a deposit position, wherein, in accordance with the invention, the flat material part is transferred by a positioning axis of the handling device, which has a greater positioning accuracy than the handling axes, and which, when positioning the flat material part in at least one bending position relative to a bending line of the bending device, is aligned parallel to the insertion plane and perpendicular to the bending line, with handling axes rigidly secured, from a measurement position to the at least one bending position.

Further advantageous developments of the method according to the invention have been explained hereinabove in conjunction with the bending apparatus described hereinabove and, therefore, reference is to be had to these in full.

Further features and advantages of the invention are the subject matter of the description given hereinbelow and of the appended drawings of several embodiments.

DETAILED DESCRIPTION OF THE INVENTION

Figure 1:
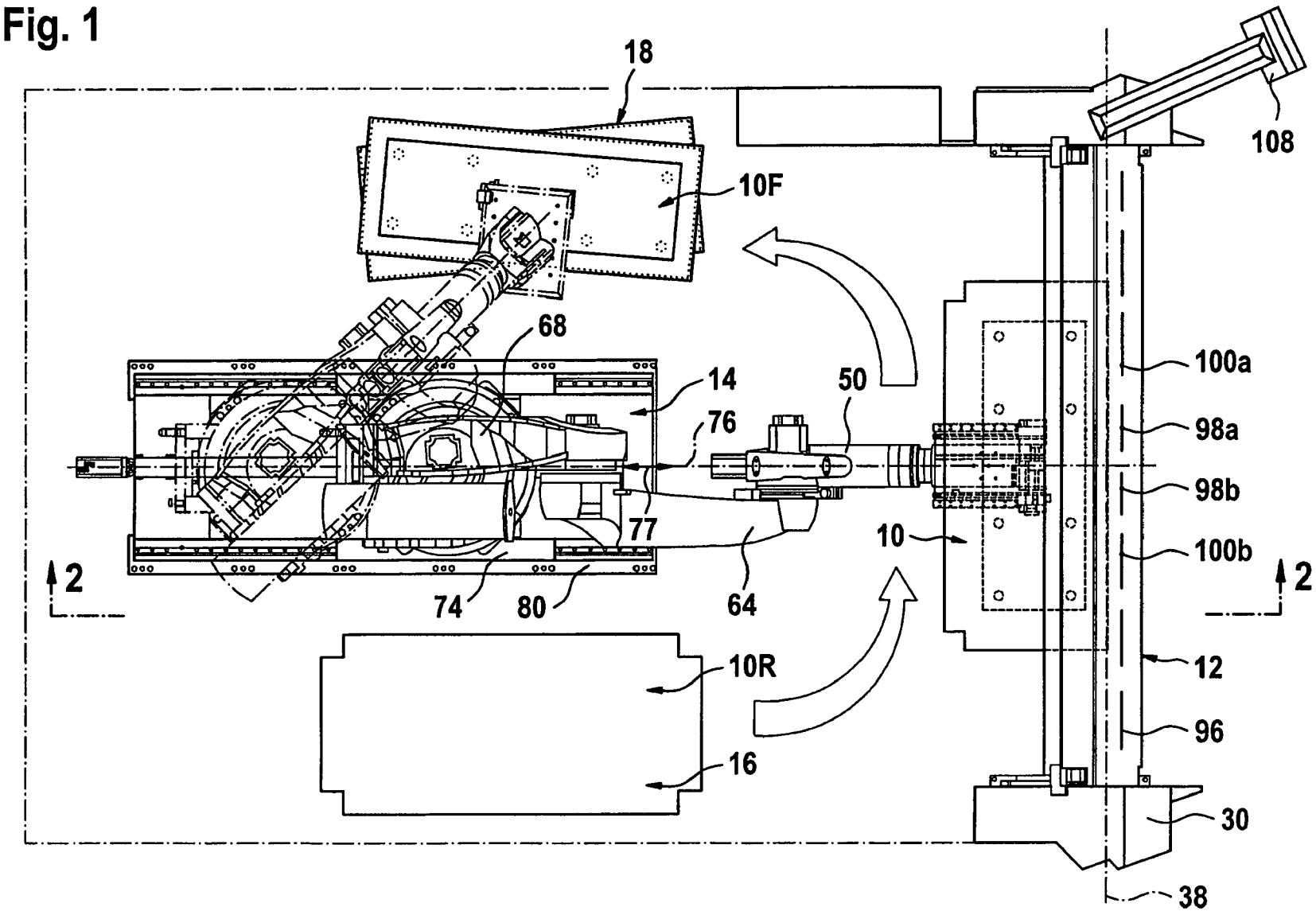
FIG. 1 is a plan view of a first embodiment of a bending apparatus according to the invention.
Figure 2:
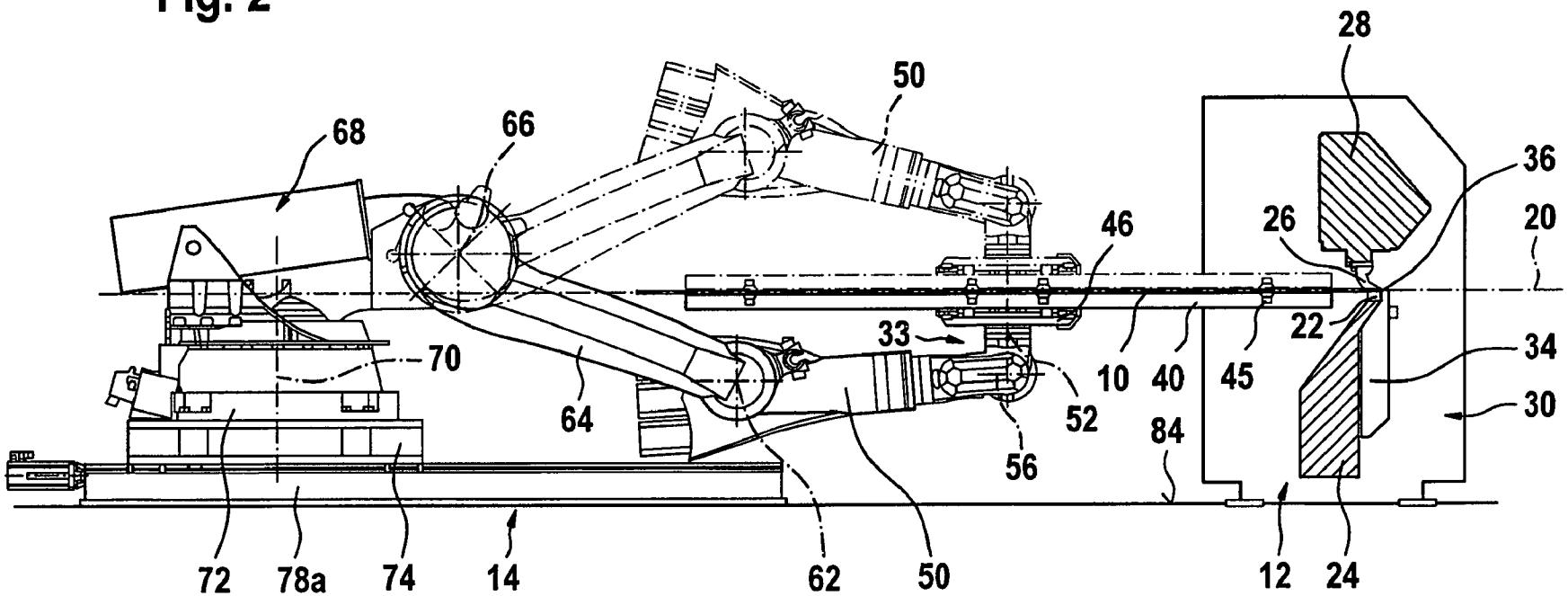
FIG. 2 is a section taken along line 2-2 in FIG. 1.

A first embodiment of a bending apparatus shown in FIGS. 1 and 2 for flat material parts 10 comprises a bending device designated 12 in its entirety for bending the flat material parts 10, and a handling device 14 for picking up the flat material parts in a feed position 16, inserting them into the bending device 12 and finally depositing them in a deposit position 18.

As shown in FIG. 2, the flat material parts 10 are positioned in an insertion plane 20 for bending in the bending device 12 and are fixed therein by a lower clamping tool 22 seated on a lower beam 24 and an upper clamping tool 26 seated on an upper beam 28 for bending by being clamped between the clamping tools 22, 26.

For example, the lower beam 24 is fixedly arranged on a machine frame 30, and the upper beam 28 is movable with the upper clamping tool 26 relative to the machine frame 30 in order to introduce the flat material part 10 between the lower clamping tool 22 and the upper clamping tool 26 and clamp it by means of these.

Furthermore, the bending device 12 comprises a bending tool 32 which is arranged on a bending beam 34 and together with the bending beam 34 is moveable relative to the machine frame 30 in order to bend the flat material part 10.

Figure 3:
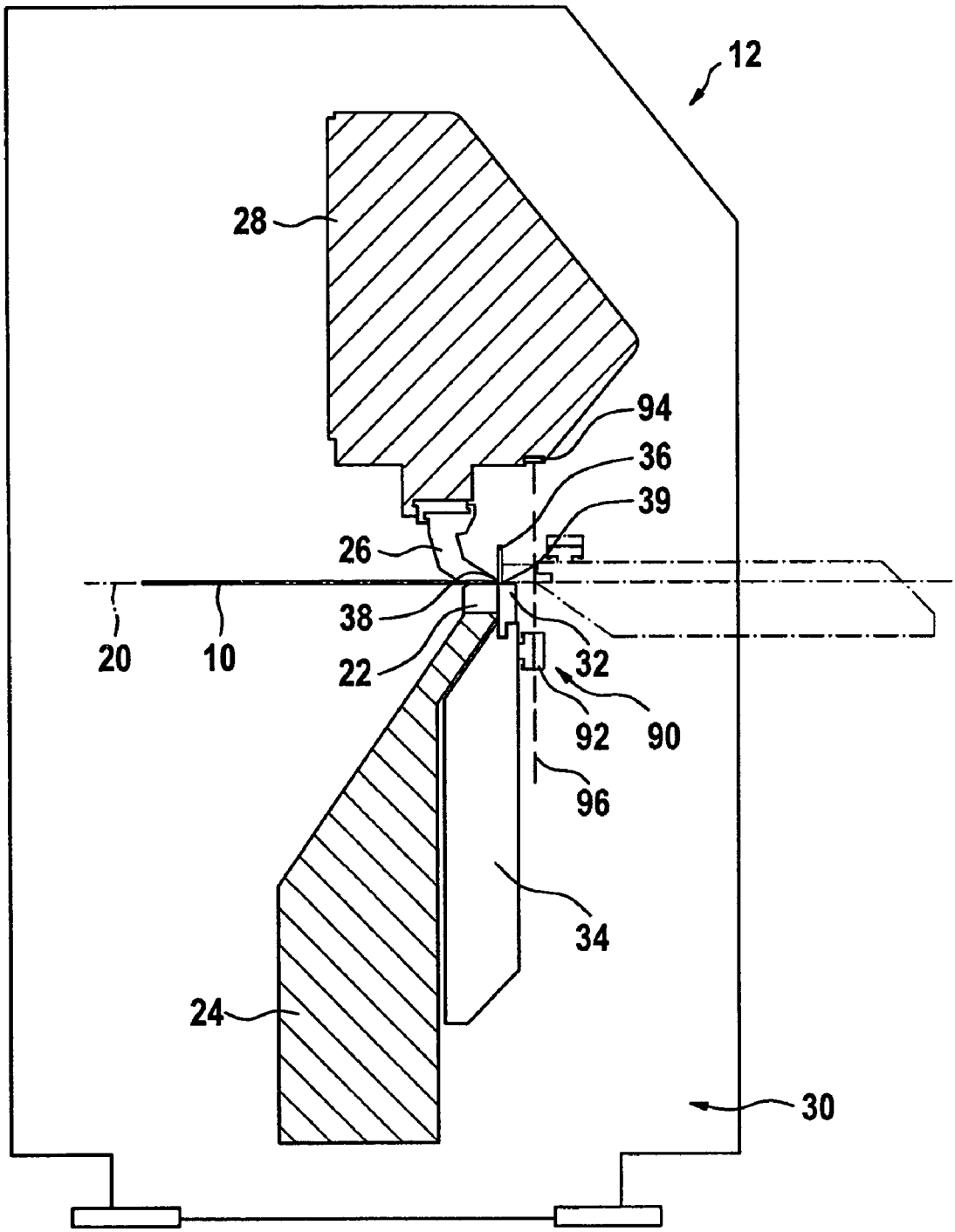
FIG. 3 is an enlarged representation of the section according to FIG. 2 in the area of a bending device with a bending tool in starting position.
Figure 4:
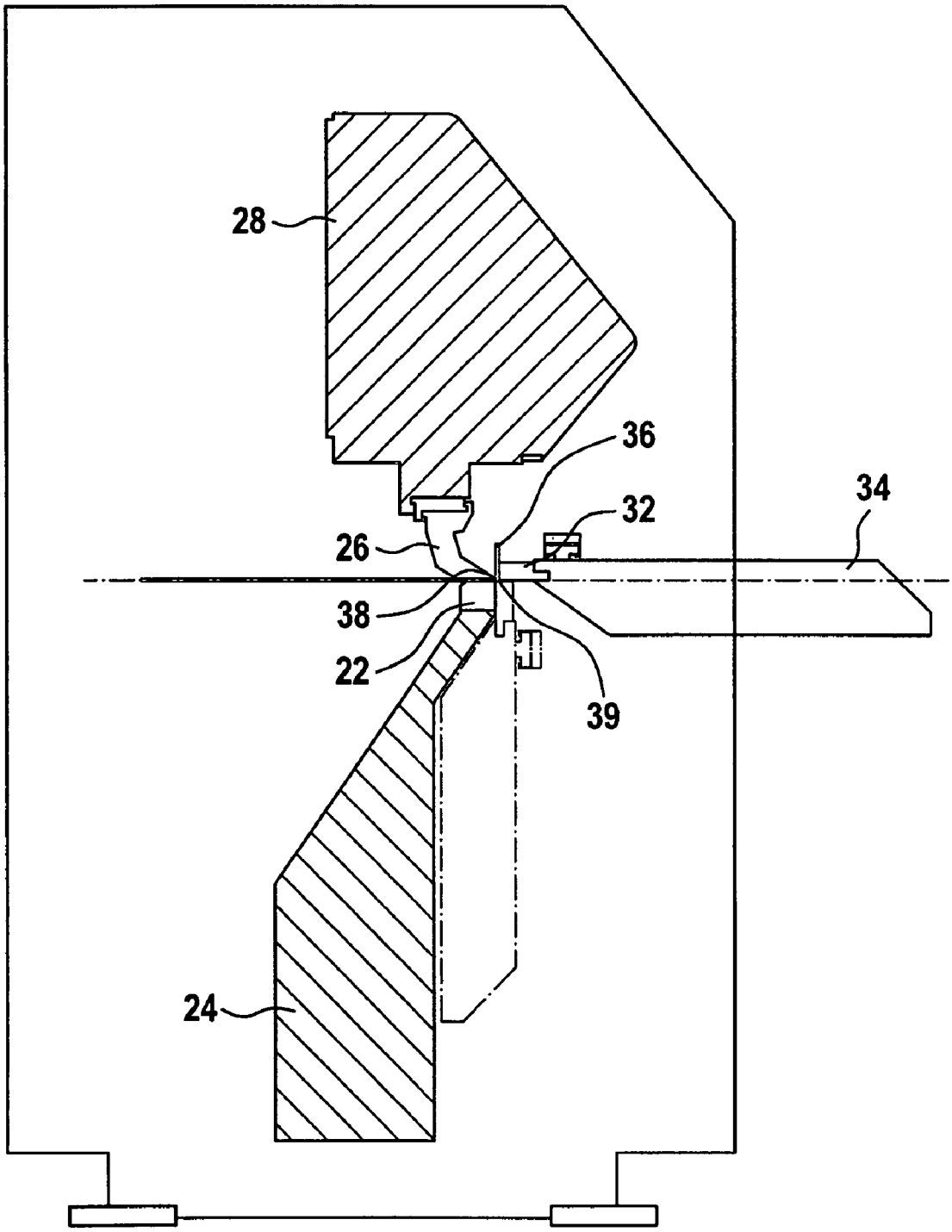
FIG. 4 is a section similar to FIG. 3 with the bending tool in a possible bending end position.

The bending tool 32 with the bending beam 34 is arranged on a side of the clamping tools 22, 26 located opposite the handling device 14 and acts on a portion 36 of the flat material part 10 projecting over the clamping tools 22, 26 on the side located opposite the handling device 14, in order to bend this portion, as shown in FIGS. 3 and 4, at a bending line 38, prescribed by one of the clamping tools 22, 26, thereby forming a bending edge 39, during which relative movement of the bending tool 32 with the bending beam 34 occurs relative to the clamping tools 22, 26.

In the case shown in FIGS. 3 and 4, the bending device 12 is configured as a swivel bending machine, i.e., a swiveling of the bending tool 32 with the bending beam 34 essentially occurs about a swivel axis which is essentially stationary in relation to the machine frame 30.

It is, however, also conceivable to move the bending tool in accordance with a different movement geometry, as described, for example, in international patent application WO 00/43141.

Figure 5:
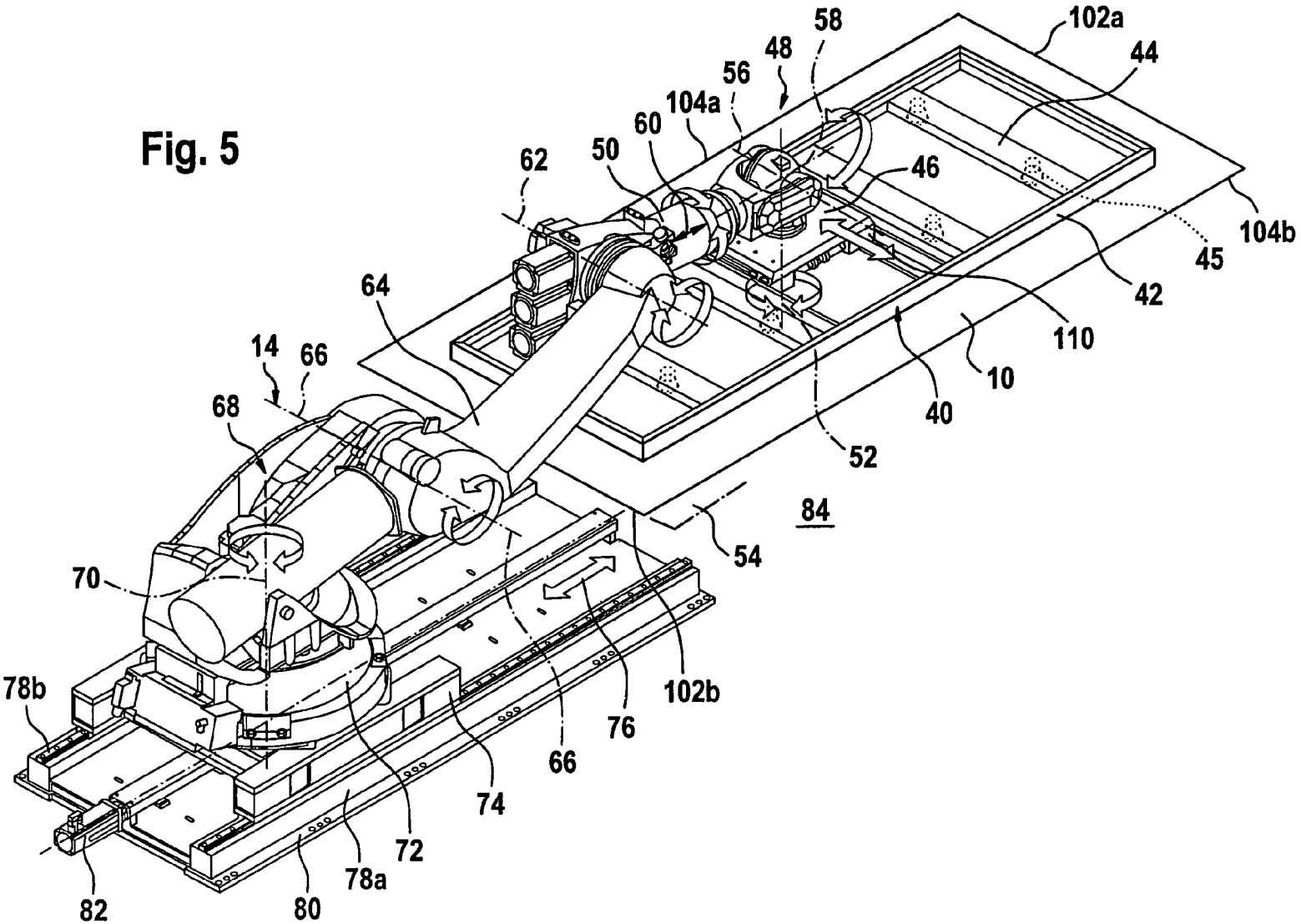
FIG. 5 is a perspective representation of a handling device and a flat material part held by the handling device for bending in the region of an edge of a narrow side.
Figure 6:
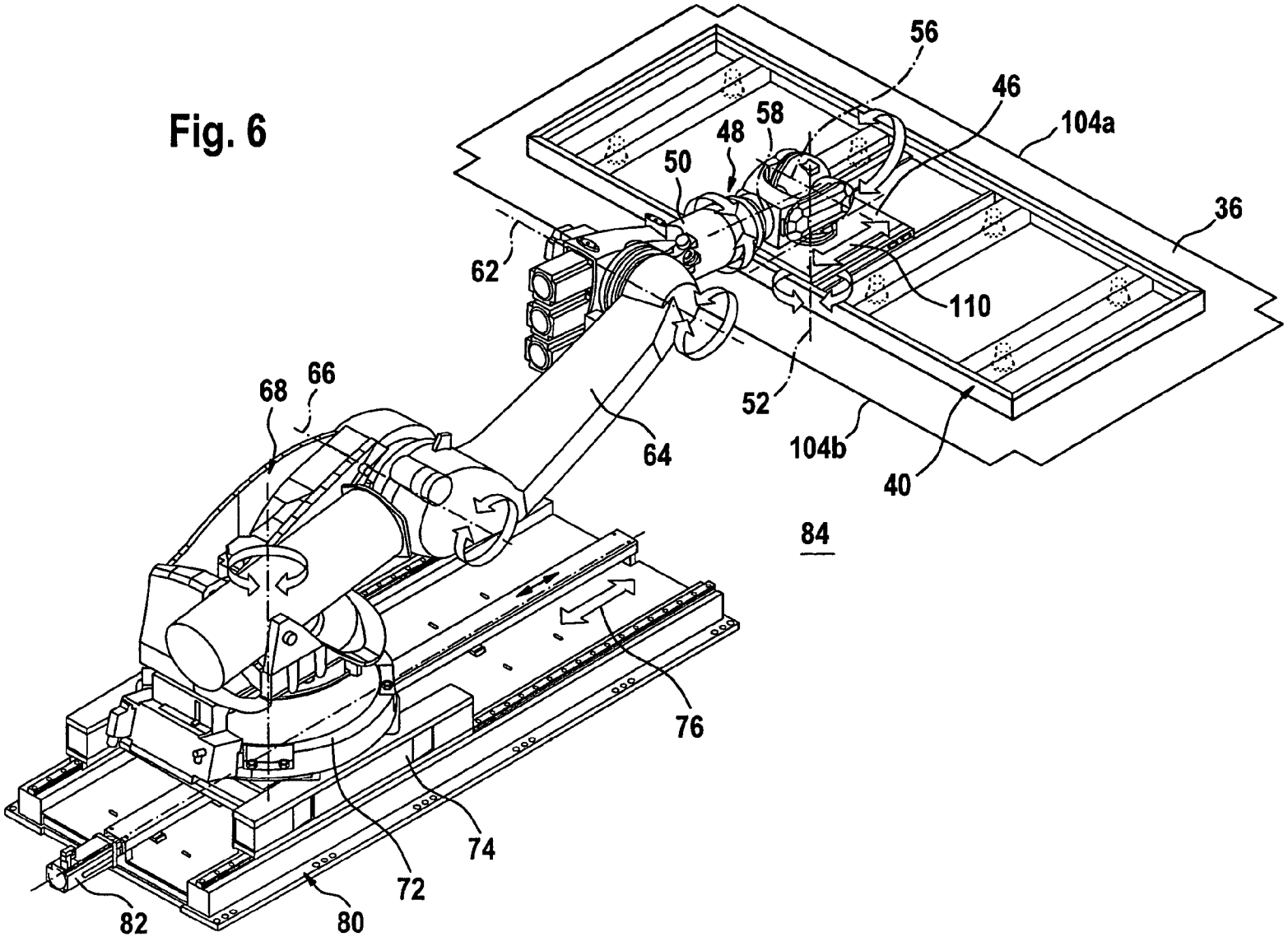
FIG. 6 is a perspective representation similar to FIG. 5 with alignment of the flat material part for bending in the region of an edge extending in longitudinal direction.

As shown in FIGS. 5 and 6, the handling device designated 14 in its entirety comprises a flat material holder 40 for receiving the flat material parts 10. The flat material holder 40 is configured as a frame 42 with cross bars 44. There are provided on the cross bars 44 fixing elements 45 which, for example, by means of negative pressure or magnetic force engage the flat material part 10 on a flat side thereof and hold it so that it lies on the frame 42.

The flat material holder 40 is held with an assembly base 46 on a triaxial joint arrangement 48 for movement about the total triaxial joint arrangement 48 relative to a first arm 50 of the handling device 14. The joint arrangement 48 makes provision for rotation of the flat material holder 40 about a first axis of rotation 52 which extends perpendicularly to a plane 54 in which the flat material part 10 extends with its portion that lies on the frame 42.

Furthermore, the joint arrangement 48 makes provision for rotatability of the flat material holder 40 relative to the first arm 50 about a second axis of rotation 56 extending parallel to the plane 54.

Finally, a third axis of rotation 58 is implemented by the joint arrangement 48. This extends transversely to the first axis of rotation 52 and transversely to the second axis of rotation 56 and preferably parallel to a longitudinal direction 60 of the first arm 50.

The first arm 50 is, in turn, connected via an axis of articulation 62 to a second arm 64 which, in turn, with an end region located opposite the axis of articulation 62 is connected via a swivel axis 66 extending parallel to the axis of articulation 62 to a swivel arm base 68 which, in turn, is rotatable about a substantially vertical axis of rotation 70 of the base relative to a foot part 72.

In a preferred embodiment, the joint arrangement 48, the first arm 50, the second arm 64 and also the swivel arm base 68 and the foot part 72 form the components, rotatable about axes of rotation or swivel axes relative to one another, of a conventional joint arm robot, with which the assembly base 46 of the flat material holder 40 is moveable in space.

In order to also provide the handling device 14 with a positioning axis 76, the foot part 72 is, in turn, arranged on a carriage 74 which is moveable in the direction of the positioning axis 76, the positioning axis 76 being aligned parallel to the insertion plane 20 and parallel to a direction 77 extending transversely, preferably perpendicularly, to the bending line 38.

The carriage 74 is mounted by means of two carriage guides 78*a* and 78*b* extending parallel to the positioning direction on a carriage carrier 80 on which a displacement drive 82 is also arranged, with which the carriage 74 is displaceable along the carriage guides 78*a, b*.

The carriage carrier 80 is, in turn, arranged on a floor surface 84 and fixedly positioned on this floor surface, on which the machine frame 30 of the bending device 12 is also stationarily arranged.

To enable exact positioning of the flat material part 10 in relation to the bending line 38, the bending device 12 is provided with a measuring device, designated 90 in its entirety, which comprises a sensor arrangement 92 and a reflector arrangement 94, with which measurement points 98*a, b*, 100*a, b* lying in a measurement plane 96 extending perpendicularly to the insertion plane 20 can be checked as to whether a rim of the flat material part 10, for example, one of the edges 102*a, b* or 104*a, b* of the flat material part 10 is positioned exactly at these measurement points 98*a, b*, 100*a, b*.

For example, the edges 102*a, b* of the flat material part 10 are detected at the measurement points 98*a, b*, and the edges

104*a, b* at the measurement points 100*a, b*, and the measuring device 90 is able to detect the alignment and position of the respective edge 102*a, b* and 104*a, b* of the flat material part 10 at the respective measurement point 98*a, b* and 100*a, b*.

With the inventive handling device 14 which is controllable by a machine control 108, it is possible to pick up a flat material part as unworked flat material part 10R in the feed position 16 with the flat material holder 40 and insert it into the bending device 12. The flat material part 10 is aligned such that, with the portion thereof over which the frame 42 engages and which extends in the plane 54, the flat material part 10 is positioned in the insertion plane 20, with the clamping tools 22, 26 also having been opened by the machine control 108, so that the plane 54 and the insertion plane coincide.

All the axes of rotation 52, 56, 58, the axis of articulation 62, the swivel axis 66 and the axis of rotation 70 of the base and, in addition, the positioning axis 76 are employable for this purpose.

When the flat material part 10 has been exactly positioned in the insertion plane 20, the flat material part 10 is displaced by the machine control 108 cooperating with the measuring device 90, which may require movement of the axes of rotation 52, 56, 58, the axis of articulation 62, the swivel axis 66 and the vertical axis of rotation 70 of the base and of the positioning axis 76, until the edge 102*a*, 102*b* or 104*a*, 104*b* is positioned exactly at the measurement points 98*a, b* or 100*a, b*. To position the edges 102*a*, 102*b* or 104*a*, 104*b* it may prove necessary to displace the flat material part 10 transversely to the measurement plane 96 and to also turn it relative to the measurement plane 96 until the exact desired position of the respective edge 102*a, b* or 104*a, b* at the two measurement points 98*a, b* or 100*a, b* is reached.

With the flat material part 10 thus aligned, the machine control 108 causes the axes of rotation 52, 56, 58, the axis of articulation 62, the swivel axis 66 and the vertical axis of rotation 70 of the base to be fixed or "frozen", so that displacement of the flat material part 10, namely exactly perpendicularly to the bending line 38, is only possible by the positioning axis 76, so as to align the flat material part 10 in relation to the bending line 38 of the bending device 12 such that the bending edge 39 can be produced along the bending line 38 by movement of the bending tool 32 at the desired point on the flat material part 10.

The alignment of the measurement plane 96 relative to the bending line 38 depends on whether the portions 36 to be bent are to have an edge 102*a, b*, 104*a, b* extending parallel to or at an incline to the bending edge 39. If the edges 102*a, b* or 104*a, b* always extend parallel to the bending edge 39, then the measurement plane 96 is also to be aligned such that it extends parallel to the bending line 38; otherwise the measurement plane 96 can also extend at a distance from the bending line 38, which varies in the direction of the bending line 38.

In the solution according to the invention, the measurement plane 96 does not have to extend at a distance from the bending line 38 that corresponds to the width of the portion 36 to be bent, but owing to the degree of freedom existing due to the positioning axis 76, the distance can be independent of the width of the portion 36 to be bent transversely to the bending edge 39 being created, as the positioning axis 76 allows an exact displacing of the flat material part 10 after detection of its edges 102*a, b* or 104*a, b*, without changing the alignment of these edges 102*a, b* or 104*a, b* relative to the bending line 38.

After bending the portion 36 extending along one of the edges 102*a*, 102*b* or 104*a*, 104 *b*, further portions extending along the same edges 102*a*, 102*b* or 104*a*, 104*b* can be bent without a new measurement of the alignment of the flat material part 10 relative to the bending line 38 having to be performed.

When turning the flat material part 10, the axes of rotation 52, 56 and 58, the axis of articulation 62, the swivel axis 66 and the vertical axis of rotation 70 of the base are, if required, then employable in addition to the positioning axis 76, in particular, in order to align the flat material part 10 with one of the other edges 102*a, b*, 104*a, b* relative to the measurement plane 96, in particular, the measurement points 98*a, b*, 100*a, b*. After alignment of the flat material part 10 with the plane 54 of the portion over which the frame 42 engages coinciding with the insertion plane 20, the axes of rotation 52, 56, 58, the axis of articulation 62, the swivel axis 66 and the horizontal axis of rotation 70 of the base are then frozen again, and solely a moving of the flat material part 10 relative to the bending line 38 by means of the positioning axis 76 extending transversely, preferably perpendicularly, to the bending line 38 is carried out so as to be able to bend all portions 36 in this alignment.

As indicated in FIG. 2 by the continuous representation of the arms 50 and 64 and the dashed representation of these arms 50 and 64, the handling device according to the invention is capable of turning the flat material part 10 and, therefore, of producing in the region of the same edge 102*a, b*, 104*a, b* bends 39 which extend in the opposite direction.

However, the axes of rotation 52, 56, 58, the axis of articulation 62, the swivel axis 66 and the vertical axis of rotation 70 of the base have to be used for this turning of the flat material part 10, so that after use thereof a measurement using the measuring device 90 is required again, with either the edge of a bent portion 36 or the position of the bending edge 39 itself being detected with the measuring device 90 in order to then move, after freezing the axes of rotation 52, 56, 58, the axis of articulation 62, the swivel axis 66 and the vertical axis of rotation 70 of the base, the flat material part 10 relative to the bending line 38 solely with the positioning axis 76, so as to obtain the exact alignment of the flat material part in relation to the bending line 38.

Owing to the constructional design of the joint arrangement 48 and the constructional size of the lower beam 24 and the upper beam 28, it is necessary, in the case of flat material parts 10 with a short length of the edges 102*a*, 102*b* and, consequently, a short extent between the edges 104*a*, 104*b*, to be able to move the flat material holder 40 up as far as possible into the bending device 12 and as close as possible to the clamping tools 22, 26.

For this reason, there is provided between the assembly base 46 and the flat material holder 40 a further movement axis, namely the holder positioning axis 110, which is aligned so as to extend approximately perpendicularly to the edges 104*a, b*, the extent of whose length is greater than that of the edges 102*a, b*.

It is, therefore, possible to displace the flat material holder 40 relative to the joint arrangement 48 in the direction of the holder positioning axis 110.

Figure 7:
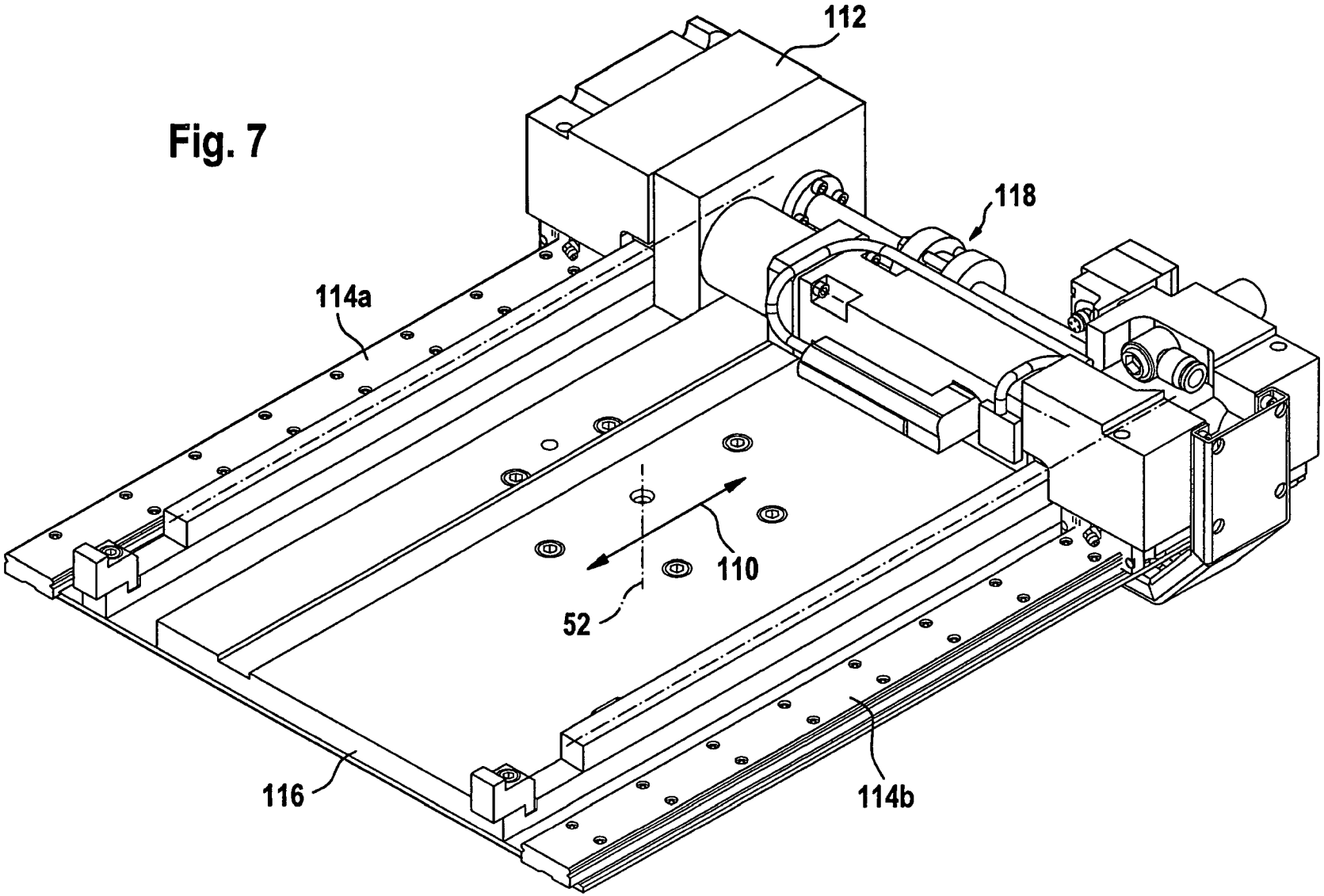
FIG. 7 is an enlarged representation of an implementation of a holder positioning axis.

As shown in FIG. 7, the holder positioning axis 110 is implemented by a holder carriage 112 being guided by means of longitudinal guides 114*a*, 114*b* on a holder carriage carrier 116 for displacement in the direction of the holder positioning axis 110, namely by means of a drive 118 which, for example, is seated on the holder carriage 112 and is able to move the holder carriage 112 in the direction of the holder positioning axis 110.

In the simplest case, only two defined positions, namely the two end positions of the holder carriage 112, are provided as possible positions of the holder carriage 112. In each of the end positions, the holder carriage 112 stands laterally next to the first axis of rotation 52, so that the first axis of rotation 52 is positionable at a shorter distance from the edge 104*a* than from the edge 104*b* or at a shorter distance from the edge 104*b* than from the edge 104*a*.

Owing to these two end positions of the holder carriage 112, the flat material holder 40 is always alignable by rotation about the first axis of rotation 52 such that it extends, starting from the first axis of rotation 52, over a greater distance in the direction of the clamping tools 22, 26, than, starting from the first axis of rotation 52, away from the clamping tools 22, 26.

Therefore, if, as shown in FIG. 6, a bending of the portion 36 near the edge 104*a* is first carried out, the holder positioning axis 110 is moved such that the first axis of rotation 52 stands closer to the edge 104*b*, as already shown in FIG. 1.

Figure 8:
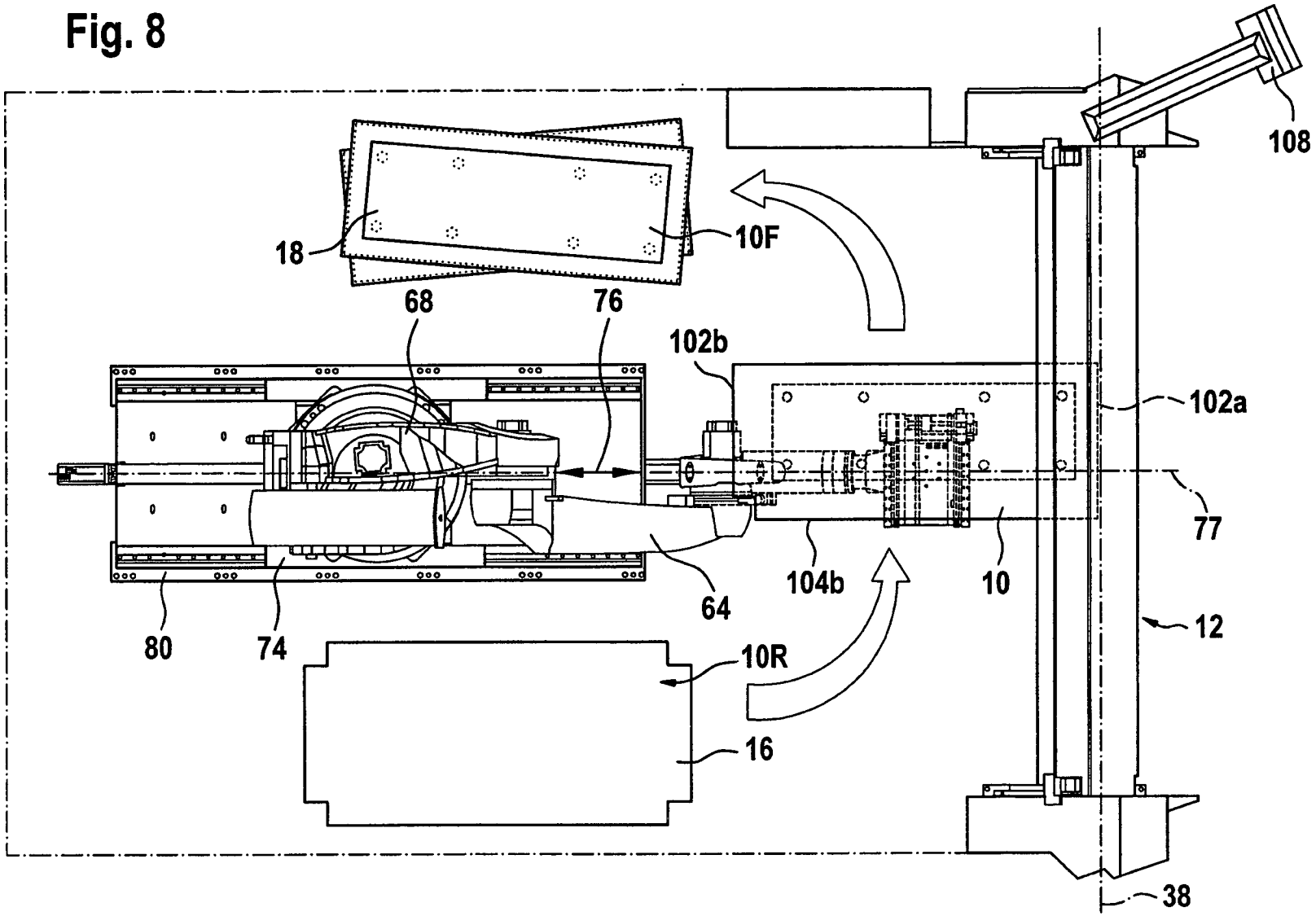
FIG. 8 is a plan view similar to FIG. 1 during the bending in the region of an edge of a narrow side.

Subsequently, the flat material holder 40 is rotated about the first axis of rotation 52, and a bending of the portion 36 near the edge 102*a* is carried out, in which case, a displacement of the holder carriage 112 in the direction of the holder positioning axis 110 is not yet necessary (FIG. 8).

Figure 9:
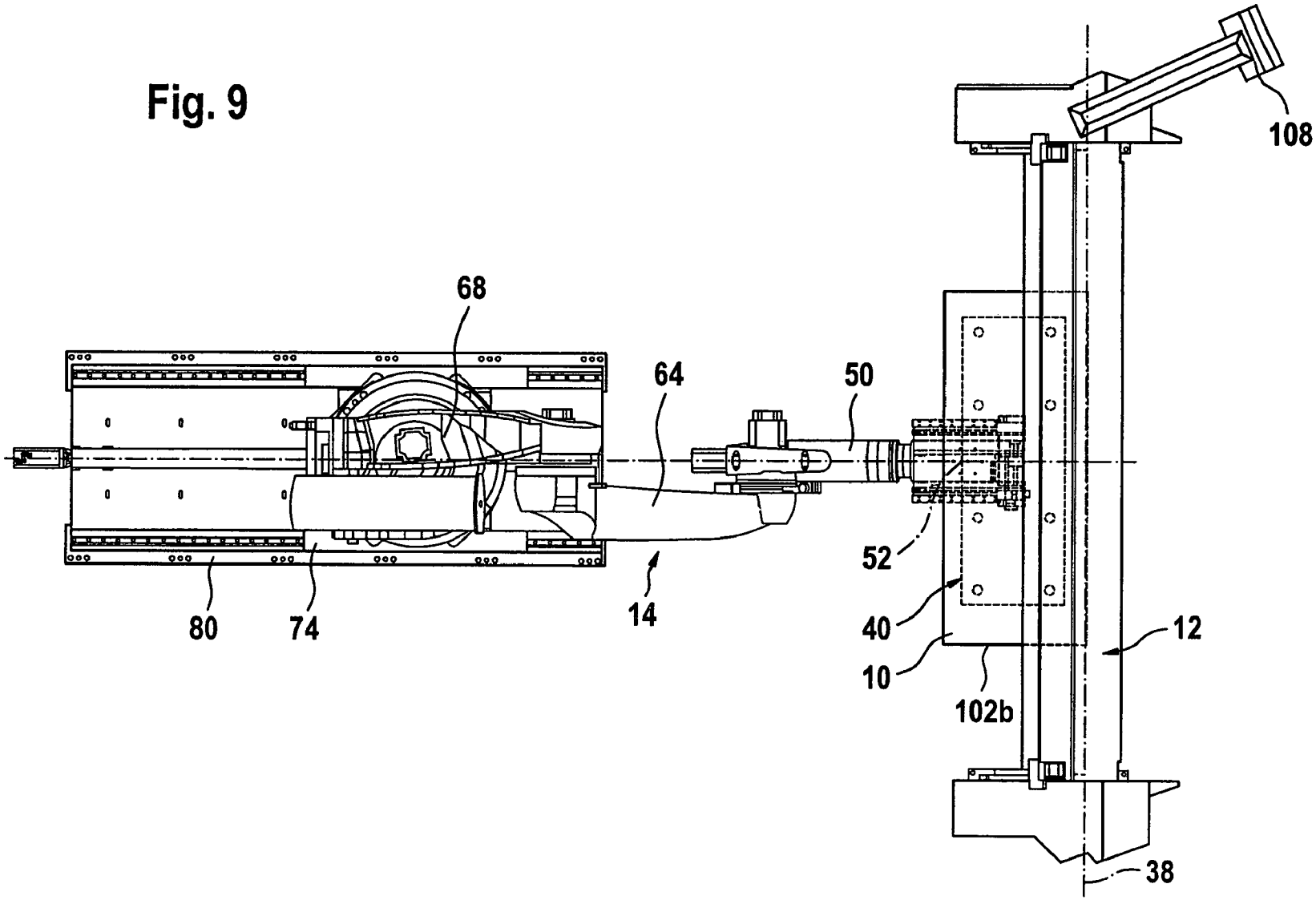
FIG. 9 is a plan view similar to FIG. 1 during the bending in the region of a second edge along a longitudinal side.

For subsequent bending of the portion 36 near the edge 104*b*, the holder carriage 112 is then displaced in the direction of the holder positioning axis 110 into the opposite end position, so that, as shown in FIG. 9, the flat material holder 40, starting from the axis of rotation 52, extends with maximum extent in the direction of the clamping tools 22, 26.

Figure 10:
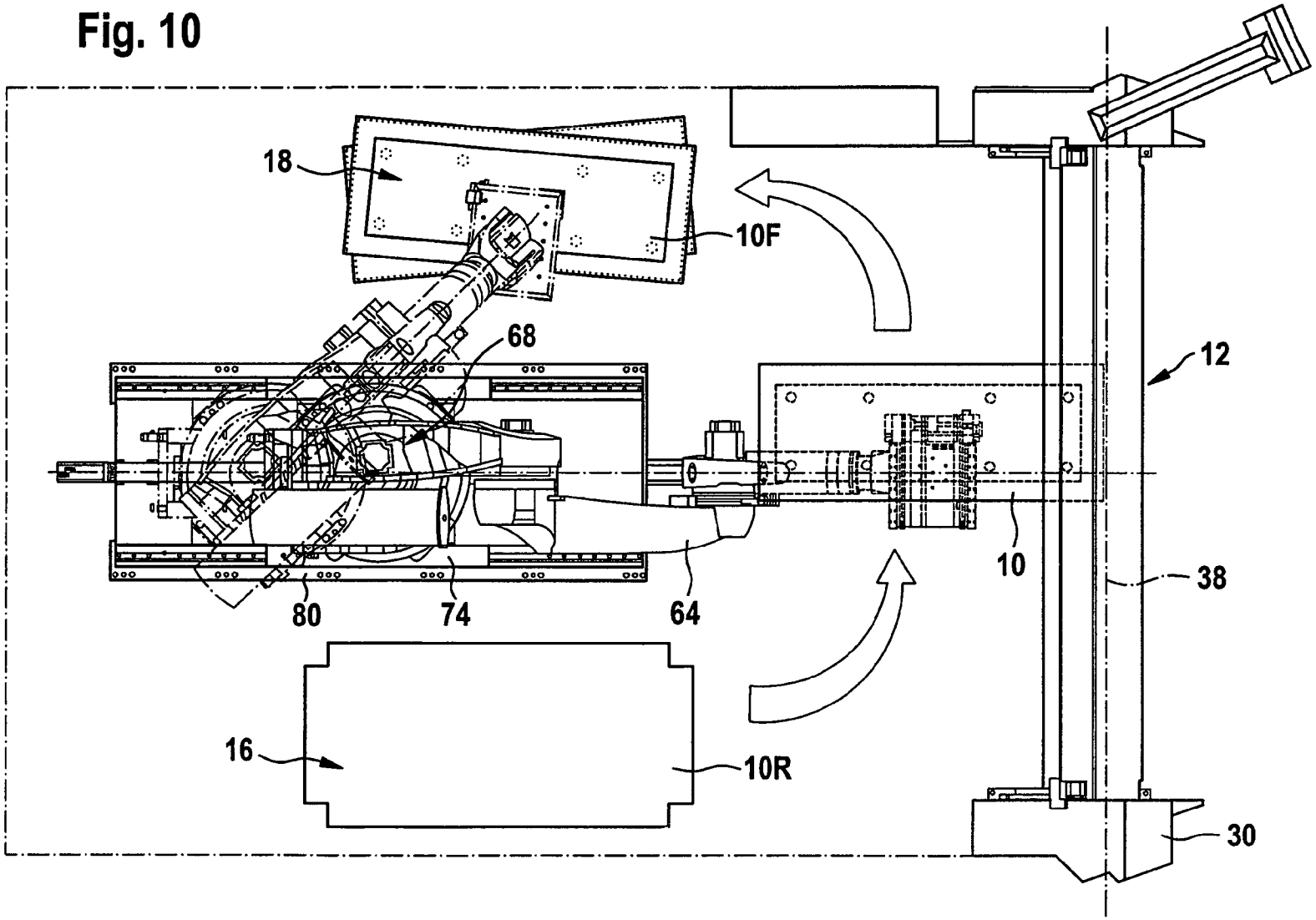
FIG. 10 is a plan view similar to FIG. 1 during the bending in the region of a second edge along a narrow side.
Figure 11:
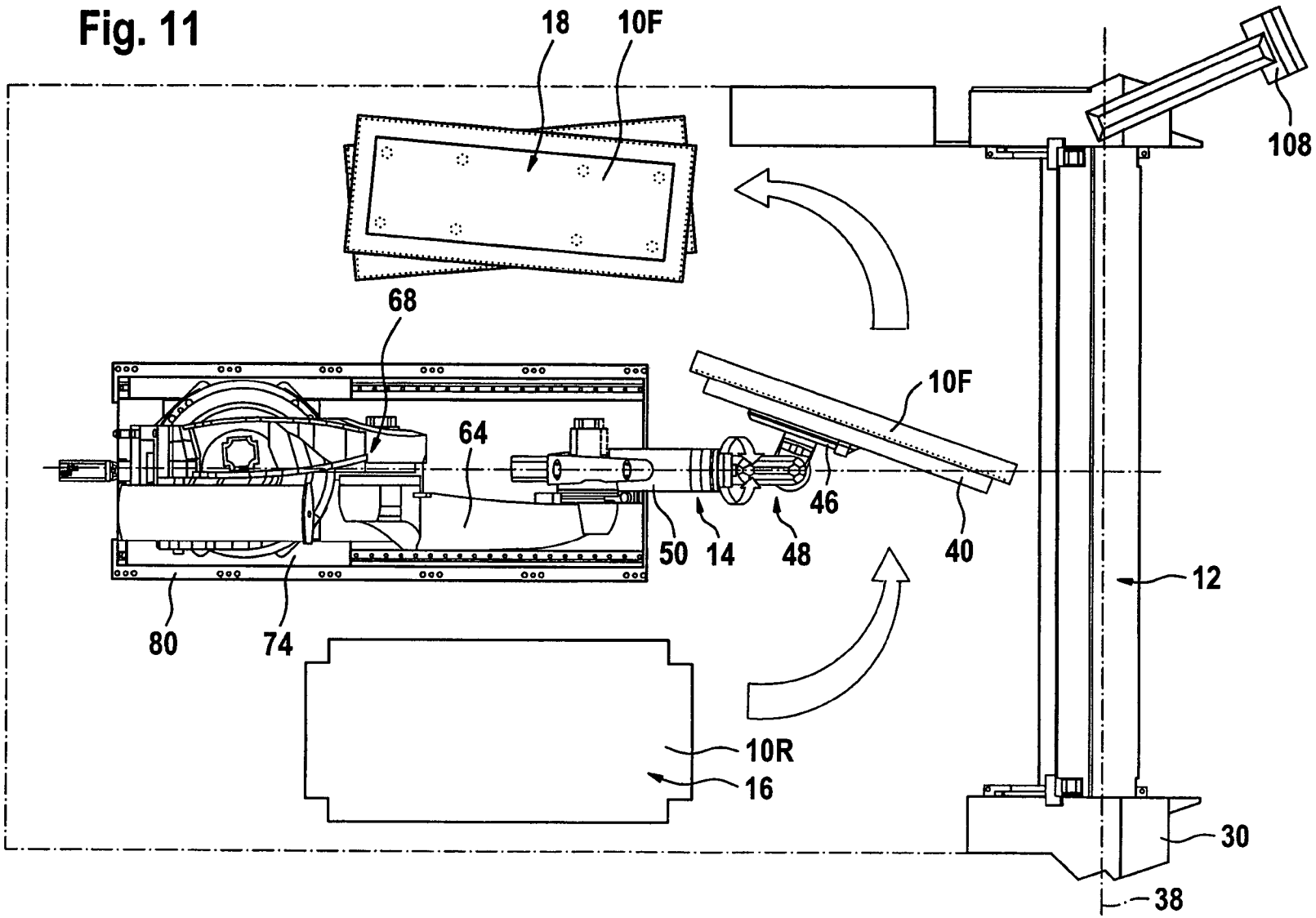
FIG. 11 is a plan view similar to FIG. 1 immediately before depositing the flat material part on which bending has been completed.

Therefore, in a last step only the portion 36 near the edge 102*b* has to be bent, as shown in FIG. 10, before the finished flat material part 10F can then finally be deposited in the deposit position 18, as shown in FIG. 11, with a rotation of the finished flat material part 10F in space being necessary in order to move it in a suitable manner out of the bending device 12.

In a second embodiment, shown in FIGS. 12 to 15, the handling device 14 is identical in construction to the first embodiment, and the bending device 12 also exhibits the same features.

However, in contrast to the first embodiment, the flat material holder 40' is constructed as a holder for small flat material parts 10', the frame 42' having in the direction of the holder positioning axis 110 an extent which, for example, is shorter than the displacement path in the direction of the holder positioning axis 110.

Figure 12:
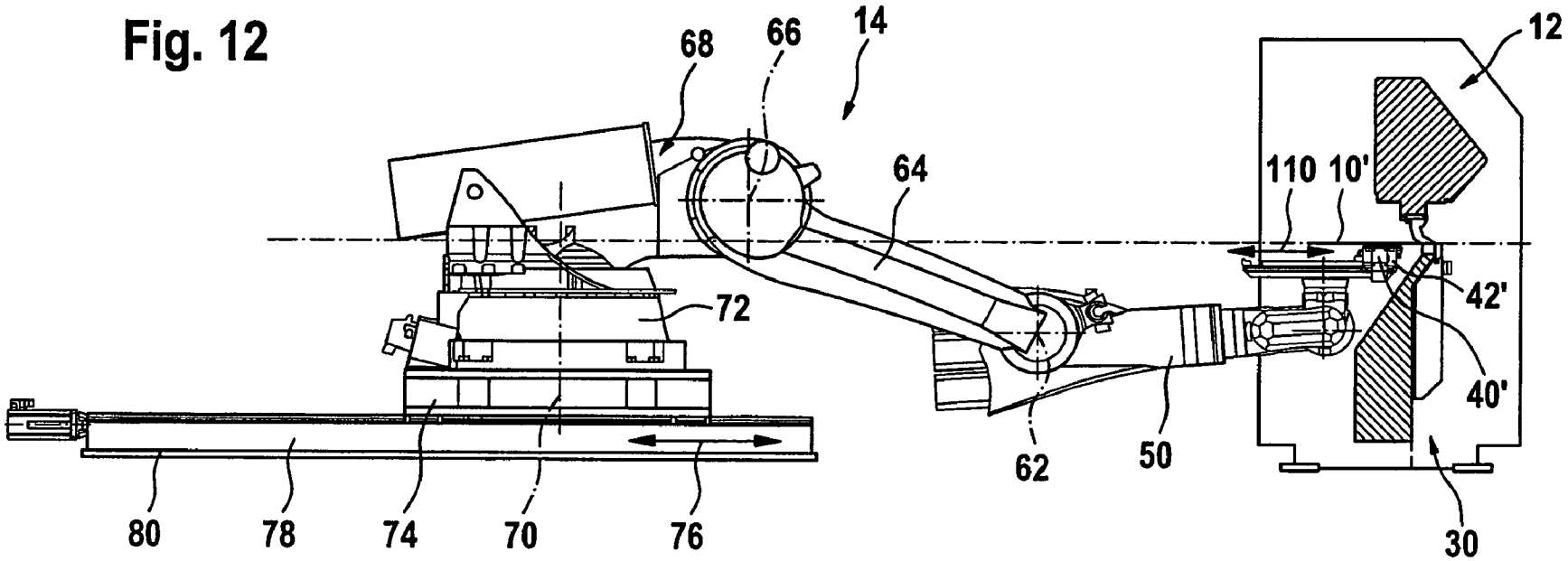
FIG. 12 is a representation similar to FIG. 2 of a second embodiment with a flat material part lying on a flat material holder.
Figure 14:
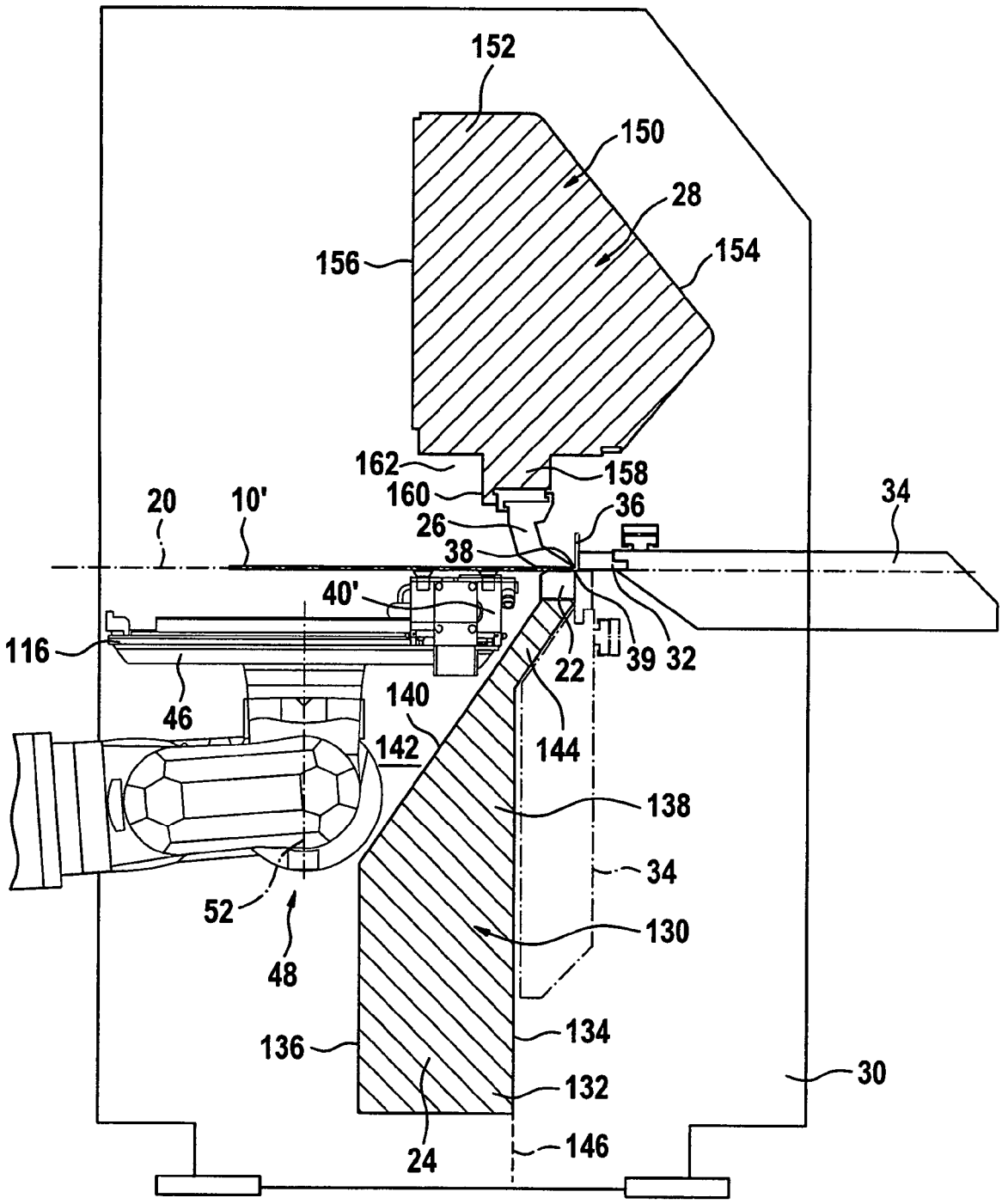
FIG. 14 is an enlarged representation of the positioning of the flat material part in the bending device corresponding to FIG. 12.

Furthermore, as shown in FIGS. 12 and 14, the lower beam 24 has a lower beam body 130 extending with a lower, widened portion 132 between a front side 134 that faces the bending beam 34 and a rear side 136 that faces the handling device 14. The front side 134 and the rear side 136 extend approximately parallel to each other.

The lower widened portion 132 of approximately rectangular cross section is followed by a portion 138 which tapers in cross section in the direction of the lower clamping tool 22. The portion 138 lies between a front side 134 continuing from the lower portion 132 into the tapering portion 138 and a drawn-in rear side 140 extending at an incline towards the front side 134 and at an incline to the rear side 136. The rear side 140 therefore creates a space 142 which is set back in relation to the rear side 136 of the lower portion 132 and in which the joint arrangement 48 can partly engage and the assembly base 46 with the holder carriage carrier 116 also at least partly. The space 142 is further increased by the tapering portion 138 being adjoined by a portion 144 of offset cross section of the lower beam body 130, which projects over the front edge 134 and ultimately carries the lower clamping tool 22.

The offset portion 144 extends over the front side 134 to such an extent that the lower clamping tool 22 ultimately lies on a side, facing away from the lower portion 132 and the tapering portion 138, of a plane 146 in which the front side 134 extends.

Therefore, as shown in FIGS. 12 and 14, the flat material holder 40' can be positioned in its position, advanced in the direction of the lower clamping tool 22, of the holder positioning axis 110 close to the lower clamping tool 22.

Figure 13:
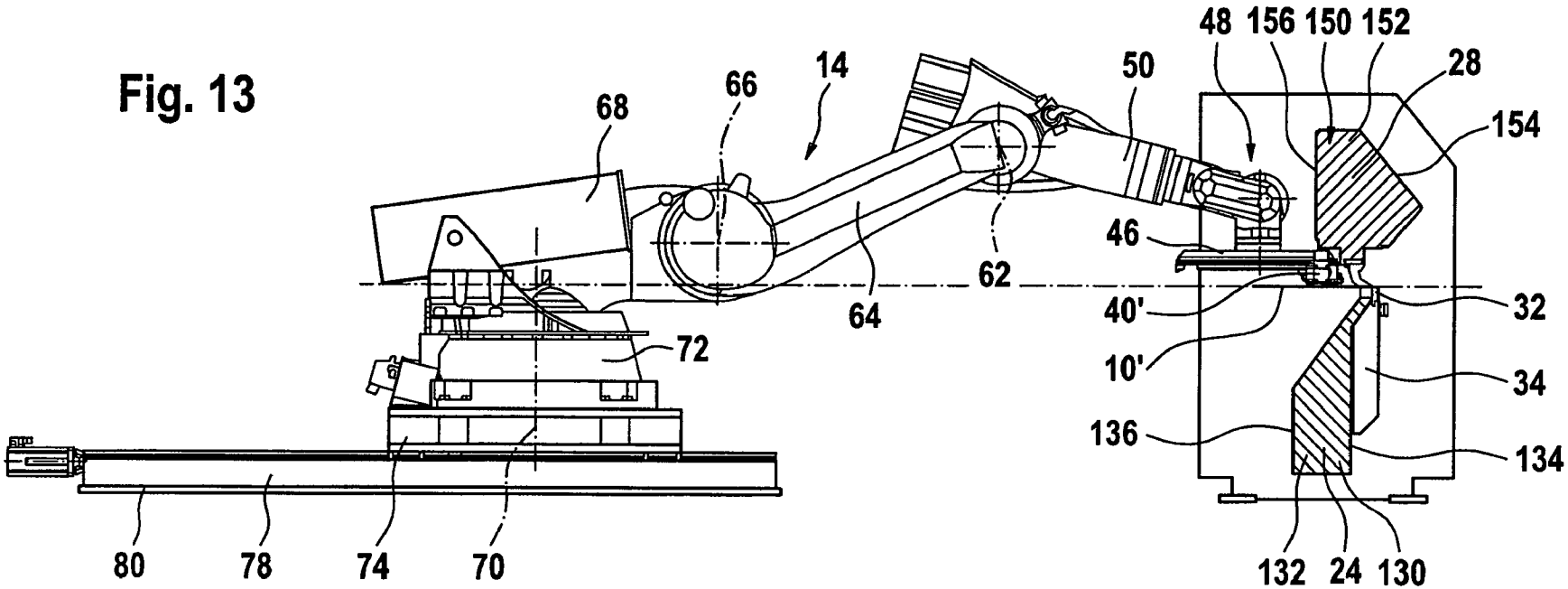
FIG. 13 is a representation similar to FIG. 12 of the second embodiment with a flat material part hanging on the flat material holder.
Figure 15:
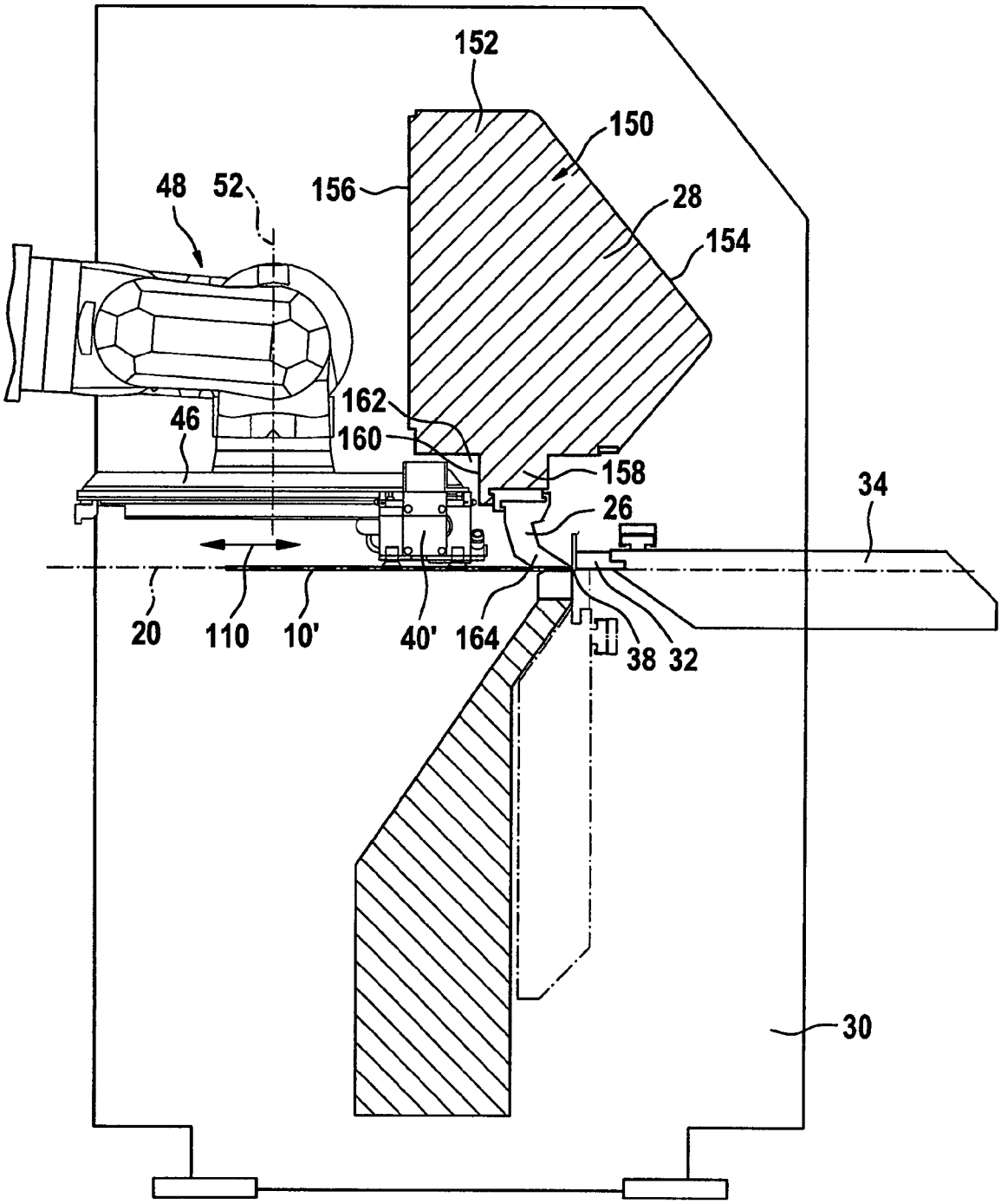
FIG. 15 is an enlarged representation corresponding to FIG. 14 of the positioning of the flat material part in accordance with FIG. 13.

To enable the flat material part 10' to be held both on its underside by the flat material holder 40', as shown in FIGS. 12 and 14, and on its upper side, as shown in FIGS. 13 and 15, the upper beam 28 also has an upper beam body 150 having an upper portion 152 of widened cross section extending between a front side 154 and a rear side 156. Below the widened portion 152 there also lies a space 162 which is set back in relation to the rear side 156 and is created by a portion 158 of tapered cross section, which lies below the widened portion 152, having a rear side 160 set back in the shape of a step in relation to the rear side 156.

The portion 158 of tapered cross section carries the upper clamping tool 26, which is preferably exchangeable and has a lower foot portion 164 whose cross section is offset in the direction of the bending line 38.

The space 162 is of such dimensions that it can be engaged by the assembly base 46 with the holder carriage carrier 116, with the flat material holder 40' displaced into its front end position so as to be able to hold the flat material part 10' as close as possible to the upper clamping tool 26.

The invention claimed is:

1. Bending apparatus for flat material parts, comprising:

a bending device at which the flat material part is positioned in an insertion plane prior to bending and remains in the insertion plane during bending, a handling device having a positioning axis and having handling axes for picking up the flat material part from a feed position, inserting it into the bending device for bending, taking it out of the bending device and placing it in a deposit position, the positioning axis having a greater positioning accuracy than the handling axes, the positioning axis, when positioning the flat material part in at least one bending position relative to a bending line of the bending device, being aligned parallel to the insertion plane and parallel to a direction extending transversely to the bending line, and, with handling axes rigidly secured, the positioning axis being adapted to transfer the flat material part from a measurement position to the at least one bending position.

2. Bending apparatus in accordance with claim 1, wherein the direction extending transversely to the bending line extends substantially perpendicularly to the bending line.

3. Bending apparatus in accordance with claim 1, wherein the handling device comprises rotational axes as handling axes.

4. Bending apparatus in accordance with claim 1, wherein one of the handling axes is an axis of rotation extending perpendicularly to a plane in which the flat material part substantially extends.

5. Bending apparatus in accordance with claim 1, wherein one of the handling axes is an axis of rotation extending parallel to the plane in which the flat material part substantially extends.

6. Bending apparatus in accordance with claim 1, wherein the handling device has at least two rotational axes as handling axes.

7. Bending apparatus in accordance with claim 1, wherein the handling device has at least five rotational axes as handling axes.

8. Bending apparatus in accordance with claim 1, wherein the handling device has at least six rotational axes as handling axes.

9. Bending apparatus in accordance with claim 1, wherein the handling device has an articulated arm comprising two arms adapted for swivel movement relative to each other about an axis of articulation.

10. Bending apparatus in accordance with claim 1, wherein the handling device comprises a flat material holder.

11. Bending apparatus in accordance with claim 10, wherein the flat material part is grippable with the flat material holder on one flat side only.

12. Bending apparatus in accordance with claim 10, wherein the flat material part carried at one end of an articulated arm and is rotatable relative thereto about three axes of rotation extending transversely to one another.

13. Bending apparatus in accordance with claim 12, wherein a first one of the axes of rotation extends perpendicularly to a plane in which the flat material part held by the flat material holder substantially extends.

14. Bending apparatus in accordance with claim 12, wherein a second one of the axes of rotation extends parallel to the plane in which the flat material part held on the flat material holder substantially extends.

15. Bending apparatus in accordance with claim 12, wherein a third one of the axes of rotation extends transversely to the axis of articulation.

16. Bending apparatus in accordance with claim 1, wherein the handling device comprises a swivel arm base.

17. Bending apparatus in accordance with claim 16, wherein an articulated arm for carrying the flat material part is adapted for swivel movement about a swivel axis relative to the swivel arm base.

18. Bending apparatus in accordance with claim 17, wherein the swivel axis extends parallel to the axis of articulation.

19. Bending apparatus in accordance with claim 16, wherein the swivel arm base is rotatable about an approximately vertical axis of rotation of the base relative to a foot part.

20. Bending apparatus in accordance with claim 1, wherein in all positions of the handling device, the direction parallel to the positioning axis extends with the same alignment transversely to the bending line.

21. Bending apparatus in accordance with claim 1, wherein in all positions of the handling device, the positioning axis extends parallel to the insertion plane.

22. Bending apparatus in accordance with claim 1, wherein the positioning axis is a linear axis.

23. Bending apparatus in accordance with claim 1, wherein the positioning axis is arranged so as to bring about a movement of all other handling axes relative to the bending device.

24. Bending apparatus in accordance with claim 23, wherein the positioning axis is an axis which moves a swivel arm base relative to the bending device.

25. Bending apparatus in accordance with claim 24, wherein the positioning axis is implemented by a carriage.

26. Bending apparatus in accordance with claim 25, wherein the carriage carries a foot part.

27. Bending apparatus in accordance with claim 1, wherein the handling device has a holder positioning axis.

28. Bending apparatus in accordance with claim 27, wherein a flat material holder is moveable relative to the handling axes by means of the holder positioning axis.

29. Bending apparatus in accordance with claim 27, wherein the holder positioning axis is configured so as to allow movement between two defined end positions.

30. Bending apparatus in accordance with claim 1, wherein the bending device comprises clamping tools which clamp the flat material part in the insertion plane.

31. Bending apparatus in accordance with claim 30, wherein the bending device comprises a bending tool arranged on a side of the clamping tools that is located opposite the handling device.

32. Bending apparatus in accordance with claim 1, wherein the bending apparatus is provided with a measuring device for detecting a position of the flat material part in the measurement position.

33. Bending apparatus in accordance with claim 32, wherein the measuring device detects the position of the flat material part at two measurement points specified at a distance from each other.

34. Bending apparatus in accordance with claim 33, wherein the measurement points are located on a side of the clamping tools that is located opposite the handling device.

35. Bending apparatus in accordance with claim 33, wherein the measurement points lie in a measurement plane which extends parallel to the bending line.

36. Bending apparatus in accordance with claim 35, wherein the measurement plane extends perpendicularly to the insertion plane.

37. Bending apparatus in accordance with claim 32, wherein the measuring device comprises a sensor arrangement for detecting the measurement points.

38. Bending apparatus in accordance with claim 37, wherein the sensor arrangement is arranged on a bending tool carrier.

39. Bending apparatus in accordance with claim 37, wherein the measuring device comprises an optical sensor arrangement and a reflector arrangement located opposite the optical sensor arrangement.

40. Bending apparatus in accordance with claim 30, wherein the clamping tools are arranged on beams which carry these.

41. Bending apparatus in accordance with claim 40, wherein a beam for a lower one of the clamping tools has a recess for at least partially receiving the flat material holder.

42. Bending apparatus in accordance with claim 40, wherein the beam carrying the upper clamping tool has a recess for at least partially receiving the flat material holder.

43. The bending apparatus of claim 1, wherein the flat material part is inserted into the bending device in a measurement position within said insertion plane for bending after said at least one bending position is reached.

44. Method for bending flat material parts with a bending device at which the flat material part is positioned in an insertion plane prior to bending and remains in the insertion plane during bending, and with a handling device which has handling axes, comprising the steps of:

picking up the flat material part from a feed position, inserting the flat material part into the bending device for bending, transferring the flat material part by a positioning axis of the handling device from a measurement position to at least one bending position, with handling axes rigidly secured, the positioning axis having a greater positioning accuracy than the handling axes, and the positioning axis, when positioning the flat material part in the at least one bending position relative to a bending line, being aligned parallel to the insertion plane and parallel to a direction extending transversely to the bending line, taking the flat material part out of the bending device and placing the flat material part in a deposit position.

45. The method of claim 44, wherein said inserting comprises inserting the flat material part into the bending device in said measurement position within said insertion plane for bending after at least one bending position is reached.

* * * * *